US006200047B1

(12) United States Patent
Holloway

(10) Patent No.: US 6,200,047 B1
(45) Date of Patent: Mar. 13, 2001

(54) SEALED LIPSTICK DISPENSER

(75) Inventor: Thomas F. Holloway, Southbury, CT (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/307,401

(22) Filed: May 7, 1999

(51) Int. Cl.[7] ..... A45D 40/04

(52) U.S. Cl. ..... 401/75; 401/68; 401/86; 401/87; 401/88; 401/98

(58) Field of Search ..... 401/75, 74, 68, 401/76, 79, 80, 98, 86, 87, 88, 116

(56) References Cited

U.S. PATENT DOCUMENTS

| | | | | |
|---|---|---|---|---|
| 3,216,563 | * | 11/1965 | Finkenzeller | 401/86 X |
| 3,256,980 | | 6/1966 | Bau | 206/56 |
| 3,275,132 | | 9/1966 | Hultgren | 206/56 |
| 3,335,854 | * | 8/1967 | Landen | 401/68 X |
| 3,807,881 | | 4/1974 | Seidler | 401/175 |
| 5,018,893 | | 5/1991 | Holloway | 401/75 |
| 5,172,993 | * | 12/1992 | Ackermann et al. | 401/80 X |
| 5,549,404 | * | 8/1996 | Kageyama et al. | 401/75 |
| 5,553,956 | * | 9/1996 | Mitsuya et al. | 401/75 X |
| 5,813,421 | * | 9/1998 | Wang | 401/68 X |
| 5,884,638 | * | 3/1999 | Ohba | 401/75 X |
| 5,888,004 | * | 3/1999 | Bouix | 401/88 X |

FOREIGN PATENT DOCUMENTS 1351560 12/1963 (FR) .

* cited by examiner

*Primary Examiner*—Henry J. Recla
*Assistant Examiner*—Kathleen J. Prunner
(74) *Attorney, Agent, or Firm*—St. Onge Steward Johnston & Reens LLC

(57) ABSTRACT

A sealed cosmetic container provides an airtight receptacle for a cosmetic stick in a dispenser with a slim appearance. The dispenser includes a nose piece with a movable elevator which operates by engagement between screw threading on a stem under the elevator cup and on a cam piece or between a lug under the elevator cup and helical tracks on a cam piece. The cam piece fits into the lower end of the nose piece and the parts are snapped together, with a bead inside the nose piece tightly engaging a lip or bead on the outside of the cam piece, to provide a seal between the two parts to prevent premature drying out of a cosmetic stick. The engaged beads also provide an enhanced swivel torque.

19 Claims, 4 Drawing Sheets

SEALED LIPSTICK DISPENSER

FIELD OF THE INVENTION

The present invention relates to the field of lipstick and cosmetic dispensers having a propelling and retracting mechanism for a cosmetic stick contained within the dispenser.

BACKGROUND OF THE INVENTION

There has been a trend in the cosmetics product market towards "non-transferable" lipstick products. These products are heavy, silicone filled lipsticks that do not transfer from the wearers lips, and leave residue, such as on a coffee cup or clothing. These lipstick formulations have a significant quantity of volatile components in their formulations. As such, they must be kept enclosed in an airtight container when not in use. If not enclosed in an airtight container, they will dry out and shrink. They will become unusable to the consumer, particularly if the lipstick shrinks and falls out of the dispenser cup. These products were first introduced to the market in slim lipstick dispensers because these dispensers had the necessary airtight construction. However, these initial slim dispenser designs also have disadvantages. These slim dispenser designs typically include an elevator cup that has a threaded rod extending downwardly into and engaging a threaded base element, and which can be operated with a twisting action to extend the cosmetic stick from a nose member. One such design is shown, for example, in my U.S. Pat. No. 5,018,893.

A disadvantage of these designs is that in order to load the dispenser with a cosmetic stick, the cosmetic stick must be formed and carefully loaded into the dispenser or cast in place in the tubular nose of the dispenser. The elevators of these dispensers cannot be bottom filled with a molten cosmetic product which is allowed to cool, in place, in a mold, so that the cosmetic is molded in place onto an elevator cup. It is to be appreciated that bottom filling of an elevator cup of a cosmetic dispenser is considered a preferred method of loading the cosmetic stick into a lipstick dispenser because it simplifies the cosmetic loading operation and reduces product loss arising from breakage of the cosmetic stick on loading. Such bottom filling methods are used with conventional lipstick dispensers where the cup size is on the order of 0.50 inches diameter. Such bottom filling methods are not generally usable in slim dispenser designs because they will use a small diameter solid threaded rod element engaged in a cam or nut element to drive the elevator. In contrast, the conventional dispensers use a combination of an innerbody with straight tracks working in combination with helical tracks on a cam sleeve to move an elevator cup by engagement with the elevator cup lugs.

Lastly, the "feel" of the existing slim dispenser designs is sometimes slack; desirably, a cosmetic dispenser should have a sufficient amount of swivel drag to give the dispenser a feel that is smooth and luxurious.

SUMMARY OF THE INVENTION

It is an object of a preferred embodiment of the invention to provide a slim cosmetic dispenser which is capable of being bottom filled with a molten cosmetic product to allow a cosmetic stick to be formed in place in the elevator cup of the dispenser. It is an object of a preferred embodiment of the invention to provide such a dispenser with an enhanced swivel drag. It is an object of the preferred embodiment of the invention to provide such a dispenser which seals to prevent premature drying and deterioration of a cosmetic stick.

These objects, and other objects which shall become apparent hereafter are accomplished by a cosmetic dispenser in accordance with one embodiment of the invention, comprising a nose element, an elevator element, and a cam element. The nose element has an internal aligning web and an internal friction bead below the aligning web. The aligning web has a non-circular aperture, preferably an oval with straight sides. The elevator element has an elevator cup at an upper end thereof and an elevator stem at a lower end thereof. The elevator cup fits into the nose element above the aligning web. The elevator stem has a non-circular external cross-sectional shape that matches and extends through the non-circular aperture. Preferably, the non-circular aperture and the matching elevator stem are flat-sided ovals.

The stem is partially threaded on at least one curved exterior wall or has external lugs. A tubular cam element has an internally threaded or tracked section that engages the partial thread ribs or lugs of the elevator element. The cosmetic dispenser is operable to cause the elevator cup to travel longitudinally in the nose element by relative rotation of the cam element and the nose element. Such relative rotation causes the internally threaded or tracked section of the cam element to engage with the partial thread ribs or lugs of the elevator element to cause the elevator element to move relative to the cam element. Preferably, additional rib elements extend laterally from flat sides of the stem sufficiently to engage the aligning web upon extension of the elevator element from the cam element to limit travel of the elevator element in the nose element to that it does not unintentionally pop free of the dispenser.

To allow for bottom filling of the cosmetic dispenser of the invention, the bottom end of the cam sleeve is open, and the elevator stem is hollow. Thus the dispenser may be bottom filled with the elevator in either the retracted or extended position.

The cam element has an upper end section for fitting into a lower section of the nose element below the aligning web. The upper end section of the cam element has an external bead or lip located below the upper edge of the cam to snap fit together with the friction bead on the inside of the nose element, to provide a seal to prevent escape of volatile components of the cosmetic stick.

The external bead and the friction bead bear against each other and thereby also provide a desired frictional drag upon rotation of the cam element relative to the nose element. Variation in the amount of swivel drag can be provided by various designs; for example, the friction bead and the external bead can extend fully around a circumference of the nose element and cam element respectively, or one or both of them can be segmented. In another embodiment, the nose element is provided with slots upwardly extending from a lower end thereof to provide resilience to the nose element for a reduced swivel drag.

Other conventional components of a dispenser may be included, such as a base element having a chamber for receiving the cam element, and a cap fittable over the nose element which snap fits to the base element.

Other objects, aspects and features of the invention in addition to those mentioned above will be pointed out in or will be understood from the following detailed description in conjunction with the drawings.

DETAILED DESCRIPTION OF THE INVENTION

Figure 1:
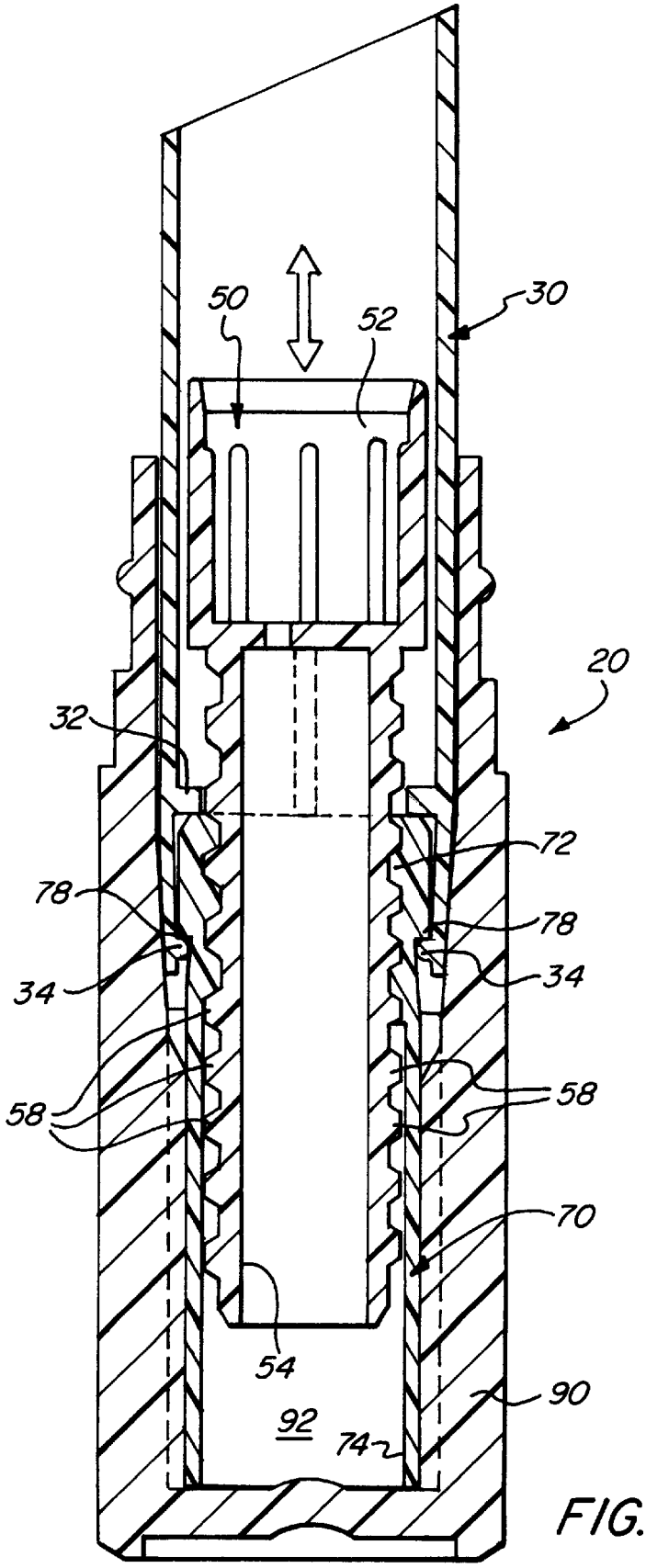
FIG. 1 is a cross-sectional elevation view of a sealed lipstick dispenser in accordance with one embodiment of the invention.

Referring now to FIGS. 1–13, where like elements are indicated with the same element numbers, a sealed cosmetic dispenser in accordance with an embodiment of the invention is shown at 20. Dispenser 20 comprises a nose element 30, an elevator element 50, and a cam element 70. The various components of the dispenser 20 are preferably molded from a plastic material to provide a degree of resilience to the components and for ease and lower costs of manufacture. In one preferred embodiment, cam element 70 is formed of ABS plastic, the nose element 30 is formed of polypropylene, and the elevator element 50 is formed of acetal copolymer.

The nose element 30 is generally tubular and has formed therein an internal aligning web 32, and an internal friction bead 34 below the aligning web 32. The aligning web 32 is generally located in the lower portion of nose element 30 and has a non-circular aperture 36. As shown, aperture 36 is preferably an oval with straight sides. The aligning web 32 serves to maintain the position of the elevator element 50 and to prevent it from rotation as described below.

Elevator element 50 has a circular elevator cup 52 at an upper end thereof and an elevator stem 54 at a lower end thereof. The elevator cup 52 fits into the nose element 30 above the aligning web 32. The elevator stem 54 has a non-circular external cross-sectional shape that matches and extends through the non-circular aperture 36. Preferably, as shown, the non-circular aperture 36 and the matching elevator stem 54 are flat-sided ovals. The matching non-circular shapes of the stem 54 and aperture 36 prevent the elevator element 50 from rotating within the nose element 30 and cam element 70.

Figure 2:
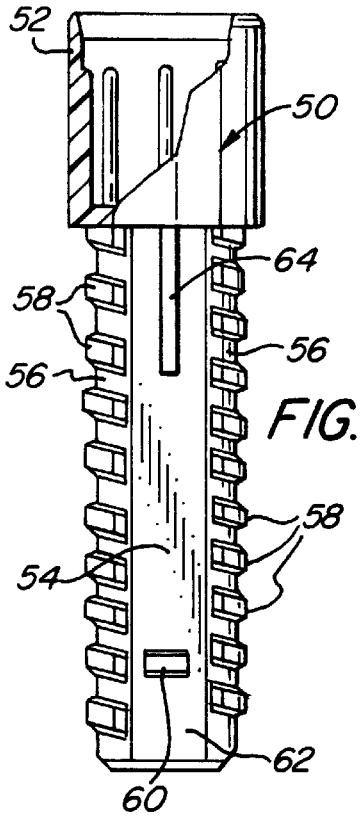
FIG. 2 is a elevation view with partial cross-section of an elevator of a sealed lipstick dispenser in accordance with one embodiment of the invention.
Figure 4:
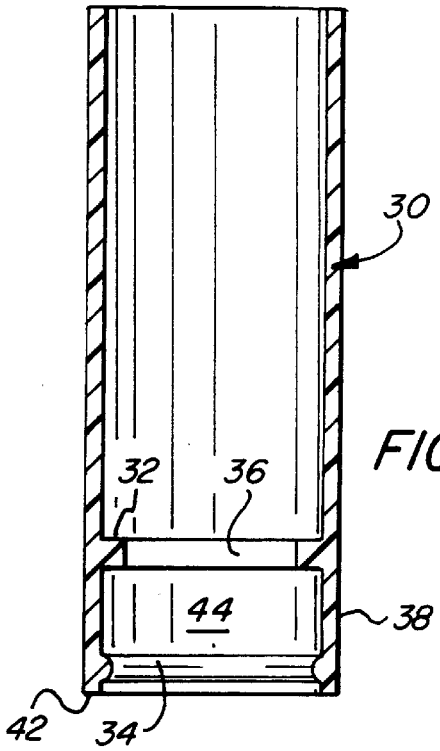
FIG. 4 is a cross-sectional elevation view of a nose of a sealed lipstick dispenser in accordance with one embodiment of the invention.
Figure 3:
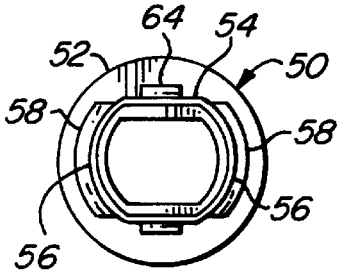
FIG. 3 is a bottom plan view of the elevator of FIG. 2.
Figure 5:
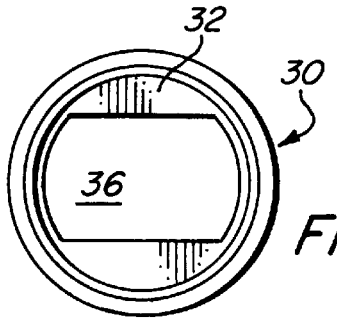
FIG. 5 is a bottom plan view of the nose of FIG. 4.

The stem 54 is partially threaded on, or has lugs on, at least one curved exterior wall 56. Preferably, as can be seen in FIGS. 2–3, there are two such curved exterior walls 56, which are provided with a plurality of partial thread ribs 58.

Tubular cam element 70 has an internally threaded or helical track section 72 (as used herein, "threaded section" shall refer to both thread or track sections) that engages thread engaging portions such as partial thread ribs 58, or lugs, associated with the elevator element 50. The cosmetic dispenser 20 is operable to cause the elevator cup 52 to travel longitudinally in the nose element 30 by relative rotation of the cam element 70 and the nose element 30. Such relative rotation causes the partial thread ribs 58 or lugs of the elevator element 50 to engage with the internally threaded section 72 of the cam element 70 to cause elevator element 50 to move relative to the threaded section 72.

Preferably, rib elements 60 are provided which extend laterally from flat sides 62 of the stem 54 near the bottom end thereof sufficiently to engage the aligning web 32 upon extension of the elevator element 50 from the cam element 70. Rib elements 60 thereby prevent the elevator element 50 from popping out of the dispenser when it is freely extended. It is to be appreciated however that the rib elements 60 are sufficiently small, and the aligning web 32 is sufficiently resilient such that rib elements 60 can be passed through aperture 36 of the nose element 30 on initial assembly of the dispenser 20.

Stop tabs 64 are provided that extend from flat sides 62 from the elevator cup 52 downwardly to a predetermined distance. Stop tabs 64 prevent excessive retraction of the elevator cup 52 by butting against aligning web 32 upon retraction of the elevator element 50.

To allow for bottom filling of the cosmetic dispenser 20, the bottom end 74 of the cam sleeve 70 is open, and the elevator stem 54 is hollow. Thus the dispenser 20 may be bottom filled with the elevator element 50 in either the retracted or extended position. In one example of an embodiment allowing bottom filling, the elevator cup 52 has an exterior diameter of about 0.50–0.55 inches and the hollow oval stem has a short diameter of about 0.3–0.33 inches, while the long diameter of the hollow stem 54 is about 0.34–0.37 inches. The overall length of the elevator element is about 1.5–1.75 inches. In such case the cam element 70 will have an exterior diameter of about 0.50–0.55 inches (the same as the elevator cup 52) and a height of about 1.2–1.4 inches. The nose element 30 will have a height of about 1.3–1.6 inches and an outer diameter of about 0.62–0.65 inches. The inner diameter of the nose element 30 will be sufficiently larger than the outer diameter of the cam element 70 so that the cam element 70 can be received snugly in the nose element 30.

Figure 6:
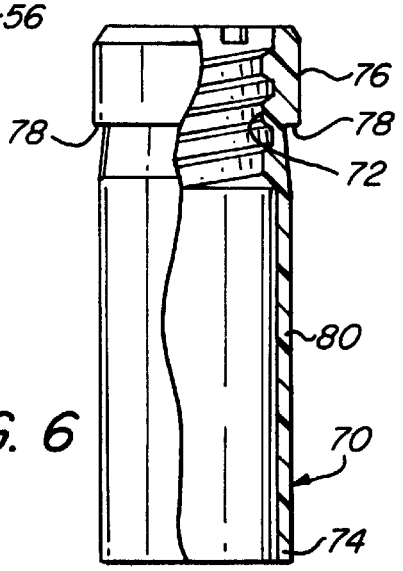
FIG. 6 is a elevation view with partial cross-section of a cam of a sealed lipstick dispenser in accordance with one embodiment of the invention.
Figure 7:
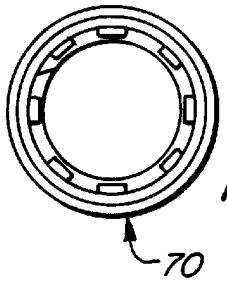
FIG. 7 is a top plan view of the cam of FIG. 6.
Figure 10:
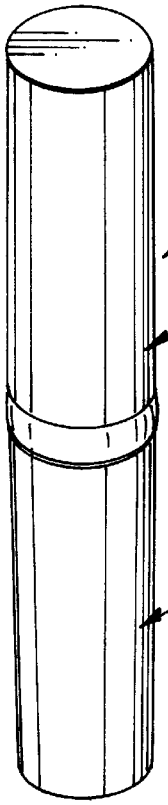
FIG. 10 is a perspective view of an assembled sealed lipstick dispenser in accordance with one embodiment of the invention.
Figure 8:
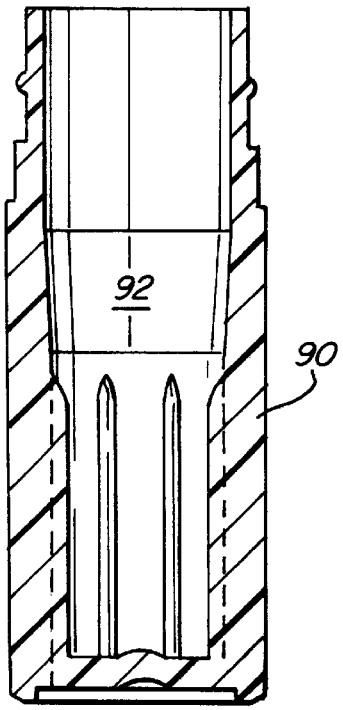
FIG. 8 is a cross-sectional elevation view of a base of a sealed lipstick dispenser in accordance with one embodiment of the invention.
Figure 9:
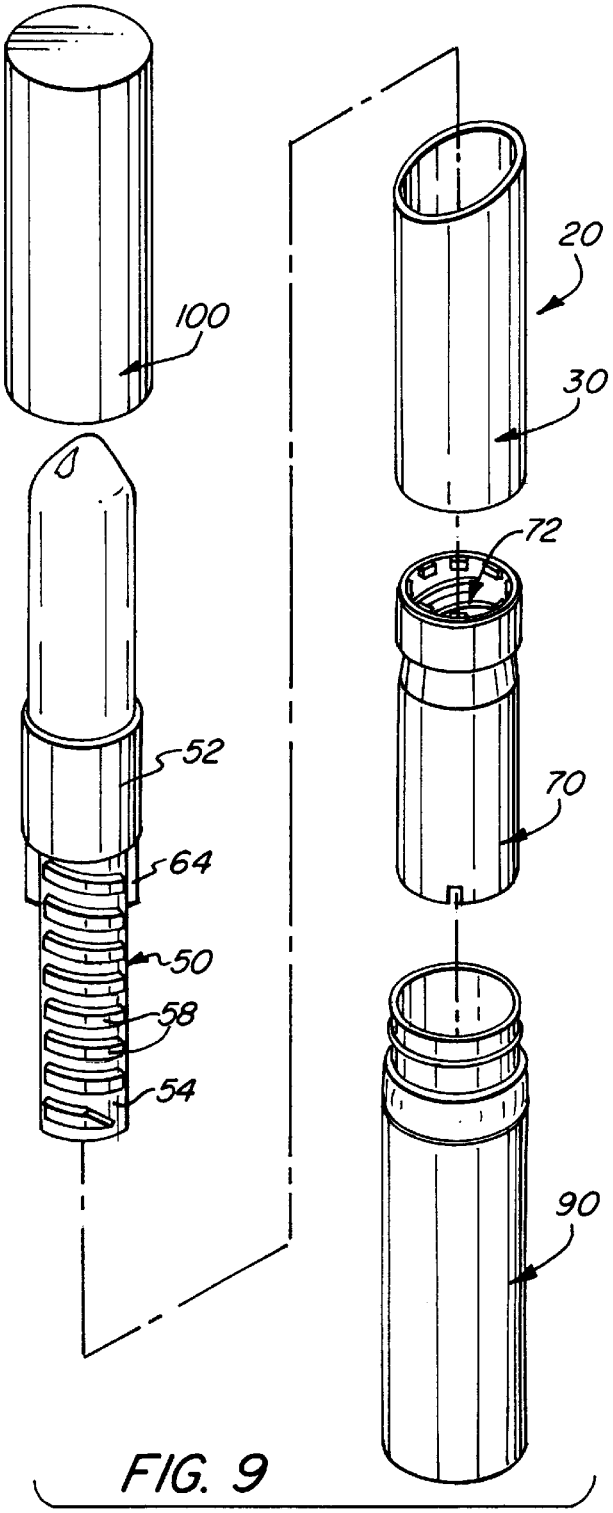
FIG. 9 is a perspective exploded view of a sealed lipstick dispenser in accordance with one embodiment of the invention.
Figure 11:
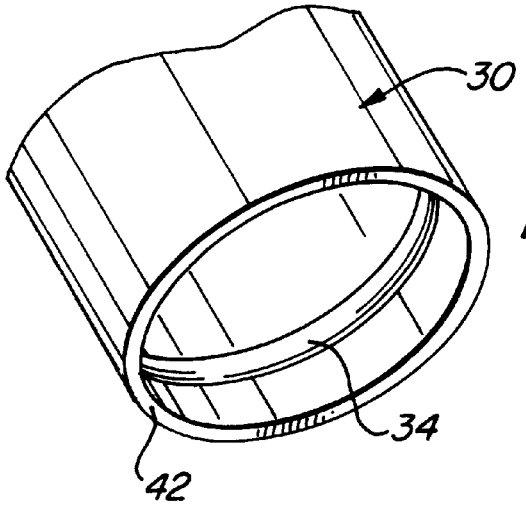
FIG. 11 is a perspective view of the lower end of a nose of a sealed lipstick dispenser in accordance with one embodiment of the invention showing a first embodiment of a friction bead.
Figure 12:
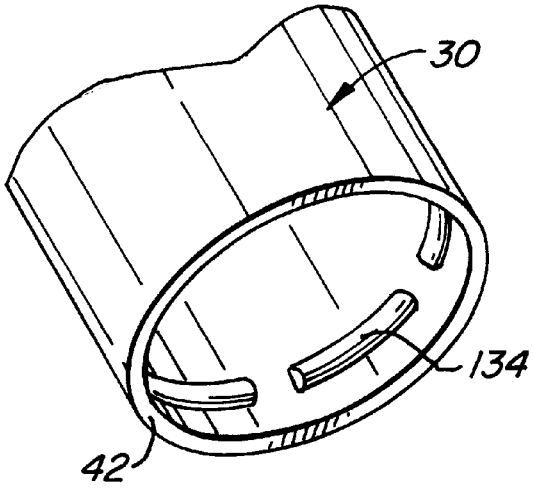
FIG. 12 is a perspective view of the lower end of a nose of a sealed lipstick dispenser in accordance with one embodiment of the invention showing a second embodiment of a friction bead.

The cam element 70 has an upper section 76 for fitting into a lower section 38 of the nose element 30 below the aligning web 32. The upper end section 76 of the cam element 70 has an external bead 78 located to snap fit together with the internal friction bead 34 of the nose element 30, to provide a seal to prevent escape of volatile compounds from the cosmetic stick when loaded into the elevator cup 52. Bead 78 may be an undercut edge formed in the cam element 70 or it may be a molded bead as is friction bead 34. In the preferred embodiment, as best shown in FIGS. 1 and 6, the upper end section 76 of the cam element 70 has a larger diameter than the lower end section 80 of the cam element 70, and fits snugly into the area 44 at the lower end 38 of nose element 30. This snug fit over a large volume helps to seal the cosmetic stick and also enhances swivel drag. Most preferably, the height of the upper end section 76 is sized so that the external bead 78 fits tightly against the friction bead 34 of the cam element to provide the desired airtight seal. The external bead 78 and the friction bead 34 bear against each other and thereby also provide a desired frictional drag upon rotation of the cam element 70 relative to the nose element 30. Variation in the amount of swivel drag can be provided by various designs; for example, the friction bead 34 and the external bead 78 can extend fully around a circumference of the nose element 30 and cam element 70 respectively, or one or both of them can be segmented. Referring now to FIG. 11, a full friction bead 34 is shown, which extends fully around the perimeter of the lower end 42 of the nose element 30. FIG. 12 illustrates a segmented bead 134 that will provide a lesser swivel drag than the full bead 34.

Figure 13:
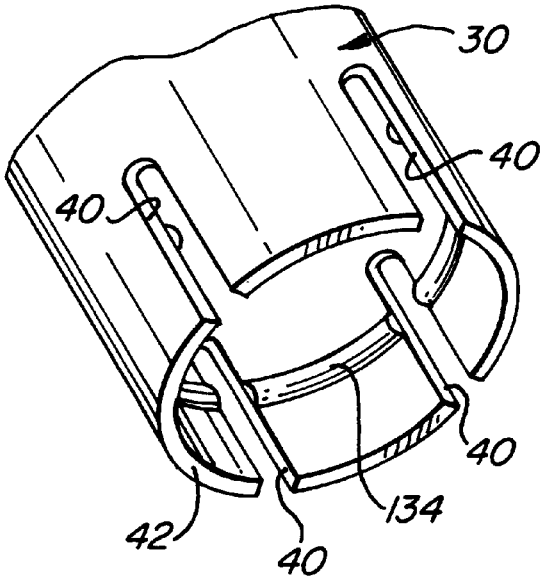
FIG. 13 is a perspective view of the lower end of a nose of a sealed lipstick dispenser in accordance with one embodiment of the invention showing a third embodiment of a friction bead with slots formed in the lower end of the nose.

FIG. 13 shows a segmented bead 134 and the nose element 30 is provided with slots 40 upwardly extending from a lower end 42 of nose element 30 to provide resilience to the nose element 30 for a further reduced swivel drag, if desired or necessary.

Other conventional components of a dispenser may be included, such as a base element 90 having a chamber 92 for receiving the cam element, and a cap 100 fittable over the nose element 30 and snap fitted to the base element 90.

It is to be appreciated that the foregoing is illustrative and not limiting of the invention, and that other modifications of the cosmetic dispenser of the invention may be chosen by persons of ordinary skill in the art, all within the scope of the invention as claimed below.

What is claimed is:

1. A cosmetic dispenser, comprising:

a tubular nose element having an aligning web and a friction bead, said aligning web being located inside said nose element and having a non-circular aperture, said non-circular aperture being a flat sided oval, said friction bead being formed inside said nose element below said aligning web;

a one-piece elevator element terminating in an elevator cup at an upper end thereof and an elevator stem at a lower end thereof, said elevator cup being fitted inside said nose element above said aligning web, said elevator stem having a non-circular external cross-sectional shape along its entire length matching and extending through said non-circular aperture, said stem having at least one curved exterior wall having thread engaging portions formed along a substantial length thereof;

a tubular cam element having an internally threaded section engaged with said thread engaging portions of said elevator element; and an upper end section for fitting into a lower section of said nose element below said aligning web, said upper end section of said cam element having an external bead located to snap fit together with said friction bead of said nose element, said external bead and said friction bead bearing against each other to provide a desired frictional drag upon rotation of said cam element relative to said nose element;

said cosmetic dispenser being operable to cause said elevator cup to travel longitudinally in said nose element by relative rotation of said cam element and said nose element.

2. A cosmetic dispenser in accordance with claim 1 wherein said elevator stem is hollow.

3. A cosmetic dispenser in accordance with claim 1 wherein one or both of said friction bead and said external bead extend fully around a circumference of the nose element and cam element respectively.

4. A cosmetic dispenser in accordance with claim 1 wherein one or both of said friction bead and said external bead are segmented around a circumference of the nose element and cam element respectively.

5. A cosmetic dispenser in accordance with claims 3 or 4 wherein said nose element is provided with slots upwardly extending from a lower end thereof to provide resilience to said nose element.

6. A cosmetic dispenser in accordance with claim 1, further comprising a base element having a chamber for receiving said cam element.

7. A cosmetic dispenser in accordance with claim 6, further comprising a cap fittable over said nose element and snap fitted to said base element.

8. A cosmetic dispenser in accordance with claim 1, further comprising rib elements extending laterally from flat sides of said stem sufficiently to engage said aligning web upon extension of said elevator element from said cam element to limit travel of said elevator element in said nose element.

9. A cosmetic dispenser, comprising:

a tubular nose element having an aligning web located inside said nose element, said aligning web having a non-circular aperture, said non-circular aperture being a flat sided oval;

a one-piece elevator element terminating in means for holding a cosmetic stick at an upper end thereof and an elevator stem at a lower end thereof, said holding means being fitted inside said nose element above said aligning web, said elevator stem having a non-circular external cross-sectional shape along its entire length matching and extending through said non-circular aperture, said stem having thread engaging portions formed along a substantial length thereof;

a tubular cam element having an internally threaded section engaged with said thread engaging portions of said elevator element; and an upper end section for mating together with a lower section of said nose element;

said cosmetic dispenser being operable to cause said holding means to travel longitudinally in said nose element by relative rotation of said cam element and said nose element.

10. A cosmetic dispenser in accordance with claim 9 wherein said elevator stem is hollow.

11. A cosmetic dispenser in accordance with claim 9 or 10 further comprising a friction bead formed inside said nose element below said aligning web, and said upper end section of said cam element having an external lip or bead located to frictionally engage said friction bead of said nose element, said external lip or bead and said friction bead bearing against each other to provide a desired frictional drag upon rotation of said cam element relative to said nose element.

12. A cosmetic dispenser in accordance with claim 11, further comprising a base element having a chamber for receiving said cam element.

13. A cosmetic dispenser, comprising:

a tubular nose element having an internal aligning flange and an internal friction bead, said aligning flange being located inside said nose element and having a non-circular aperture being a flat sided oval, said friction bead being formed inside said nose element below said aligning flange;

a one-piece elevator element terminating in means for holding a cosmetic stick at an upper end thereof and a stem at a lower end thereof, said elevator stem having a non-circular external cross-sectional shape along its entire length matching and extending through said non-circular aperture, said stem having partial thread ribs formed along a substantial length thereof;

a tubular cam element having: an internally threaded section engaged with said partial thread ribs of said elevator element; and an upper end section for fitting into a lower section of said nose element below said aligning flange, said upper end section of said cam element having an external lip or bead located to snap fit together with said friction bead of said nose element, said lip or external bead and said friction bead bearing against each other to provide a sealing fit to prevent vapor leakage therefrom and to provide a desired frictional drag upon rotation of said cam element relative to said nose element;

said cosmetic dispenser being operable to cause said holding means to travel longitudinally in said nose element by relative rotation of said cam element and said nose element.

14. A cosmetic dispenser in accordance with claim 13 wherein said elevator stem is hollow.

15. A cosmetic dispenser in accordance with claims 13 or 14 wherein one or both of said friction bead and said external lip or bead extend fully around a circumference of the nose element and cam element respectively.

16. A cosmetic dispenser in accordance with claims 13 or 14 wherein one or both of said friction bead and said external lip or bead are segmented around a circumference of the nose element and cam element respectively.

17. A cosmetic dispenser in accordance with claim 16 wherein said nose element is provided with slots upwardly extending from a lower end thereof to provide resilience to said nose element.

18. A cosmetic dispenser in accordance with claim 13, further comprising a base element having a chamber for receiving said cam element.

19. A cosmetic dispenser in accordance with claim 18, further comprising a cap fittable over said nose element and snap fitted to said base element.

* * * * *